US005413229A

United States Patent [19]

Zuberbuhler et al.

[11] Patent Number: 5,413,229

[45] Date of Patent: May 9, 1995

[54] SHELF ALLOCATION AND MANAGEMENT SYSTEM

[76] Inventors: H. Richard Zuberbuhler, 401 Fourth Ave., Beaver Falls, Pa. 15010; James R. Burchell, 318 New York Ave., Clairton, Pa. 15025; David F. Sorosky, 491 Front St., Box 182, Glenwillard, Pa. 15046

[21] Appl. No.: 12,908

[22] Filed: Feb. 3, 1993

[51] Int. Cl.[6] ..... A47F 5/00

[52] U.S. Cl. ..... 211/59.3; 211/51

[58] Field of Search ..... 211/59.3, 51

[56] References Cited

U.S. PATENT DOCUMENTS

| | | | |
|---|---|---|---|
| 1,702,987 | 2/1929 | Wilson | 211/59.3 X |
| 1,703,987 | 3/1929 | Butler | 211/59.3 X |
| 1,910,046 | 5/1933 | Pascoe | 211/59.3 |
| 2,079,754 | 5/1937 | Waxgiser | 312/71 |
| 2,098,844 | 11/1937 | Waxgiser | 211/59.3 |
| 2,980,259 | 4/1961 | Foulds | 211/59.3 |
| 3,083,067 | 3/1963 | Vos et al. | 312/71 |
| 3,357,597 | 12/1967 | Groff | 211/59.3 X |
| 4,042,096 | 8/1977 | Smith | 211/49 D |
| 4,730,741 | 3/1988 | Jackle, III et al. | 211/59.3 |
| 4,762,236 | 8/1988 | Jackle, III et al. | 211/59.3 |
| 4,830,201 | 5/1989 | Breslow | 211/184 |
| 4,901,869 | 2/1990 | Hawkinson et al. | 211/59.3 |
| 4,907,707 | 3/1990 | Crum | 211/59.3 |
| 5,012,936 | 5/1991 | Crum | 211/59.3 |

*Primary Examiner*—Alvin C. Chin-Shue
*Assistant Examiner*—Sarah L. Purol
*Attorney, Agent, or Firm*—Webb Ziesenheim Bruening Logsdon Orkin & Hanson

[57] ABSTRACT

A shelf allocation and management system for allocating shelf space among rows of products and for moving the rows of products toward the front of the shelf is disclosed. The system includes a plurality of adjacent side rails positioned along the shelf extending from front to back. Each side rail includes a generally flat rail base and a rigid divider attached to and extending away from the rail base, wherein at least one row of products may be positioned between the dividers of adjacent side rails. An unbiased backstop is positioned between dividers of adjacent side rails, wherein the backstop is movable between the front and the back of the shelf and is adapted to advance at least one row of products toward the front of the shelf. A rigid puller member positioned between the dividers of adjacent side rails is associated with the backstop. The puller member is adapted to be manually moved to move the backstop at least toward the front of the shelf.

21 Claims, 9 Drawing Sheets

SHELF ALLOCATION AND MANAGEMENT SYSTEM

BACKGROUND OF THE INVENTION

1. Field of the Invention

The present invention relates to a shelf allocation and management system for allocating shelf space among rows of products and for moving the rows of products toward the front of the shelf.

2. Prior Art

In stores, for example, grocery stores, that display products on shelves for sale, it is essential that the products be arranged as close as possible due to limited amount of space. Furthermore, it is necessary to continuously move the products to the front of the shelf so that customers can see and select those items they desire. If the products are hidden or if an insufficient depth of the shelf is utilized and the product is exhausted, potential sales are lost.

The prior art has addressed this problem and developed relatively complex machines to advance rows of products on a shelf. These machines are generally limited to a specific size display and do not maximize the amount of total shelf space which may be utilized for products.

U.S. Pat. Nos. 4,762,236; 4,830,201; 4,907,707 and 5,012,936 disclose complex mechanisms for advancing product rows which provide a spring-biased backstop which constantly forces the products toward the front of the shelf. The constant biasing feature provides for automatically moving the row of products to the front of the shelf. However, there is a drawback of potentially damaging certain products by exerting a constant pressure thereon (for example, loaves of bread, types of pasta, etc.). Additionally, the constantly biased backstop can increase the difficulty of restocking the shelves from the rear of the shelf as desired. In most of these arrangements, the spring-biased backstop must be held with one hand while the new products are positioned between the backstop and the products already on the shelf.

U.S. Pat. No. 2,079,754 discloses a complex arrangement which combines the dispensing of the products with the movement of the products toward the front of the shelf. This arrangement is limited to situations where article dispensing is to be incorporated into the operation of the shelf and is not appropriate for all types of shelves.

These prior art systems are relatively expensive, cannot be used on a wide variety of shelves, do not maximize the amount of shelf space which can be used for products and are not adapted for a wide variety of product shapes and types. The objects of the present invention are to overcome the drawbacks of the prior art systems and to provide a cost-effective shelf allocation and management system which can efficiently advance product rows toward the front of the shelf which allows for a wide variety of package width and which minimizes the space between product rows.

SUMMARY OF THE INVENTION

The present invention achieves the above objects by providing a shelf allocation and management system which allocates shelf space among rows of products and provides for moving the rows of products toward the front of the shelf. The shelf allocation and management system of the present invention includes at least two adjacent side rails positioned on the shelf. The rails extend from the front of the shelf to the back of the shelf. Each side rail includes a generally flat rail base and a rigid divider attached to the rail base extending upwardly away from the rail base. At least one row of products may be positioned between the dividers of adjacent side rails. An unbiased backstop is positioned between the dividers of adjacent side rails. The backstop is movable between the front and back of the shelf and is adapted to engage and advance the row of products positioned between the dividers of the adjacent side rails toward the front of the shelf. A rigid puller member is positioned between the dividers of the adjacent side rails and is associated with the backstop. The puller member is adapted to be manually moved to move the backstop at least toward the front of the shelf.

In several embodiments of the present invention, some of the products which are positioned between the dividers of adjacent side rails are supported on the rail bases of the adjacent side rails. This arrangement provides a space between the puller member and the products, thereby assuring free movement of the puller member.

In certain embodiments of the present invention, the backstop includes a backstop base attached to a back plate. The back plate extends generally upwardly from the backstop base. A slot is provided in the back plate which is adapted to slideably receive the puller member. The puller member extends through the slot and includes a backstop engaging portion. The backstop engaging portion is adapted to be abutted against the back plate to move the back plate and a row of products during the manual movement of the puller member.

Other embodiments of the present invention provide a puller member which is integral with a backstop. Furthermore, a plurality of grip mechanisms for the puller member is disclosed. Each puller member includes a grip mechanism which is provided on an end of the puller member which is adjacent the front of the shelf.

A complete understanding of the present invention will be obtained from the following description when taken in connection with the accompanying drawings, wherein like reference characters identify like parts throughout.

DESCRIPTION OF THE PREFERRED EMBODIMENTS

Figure 1:
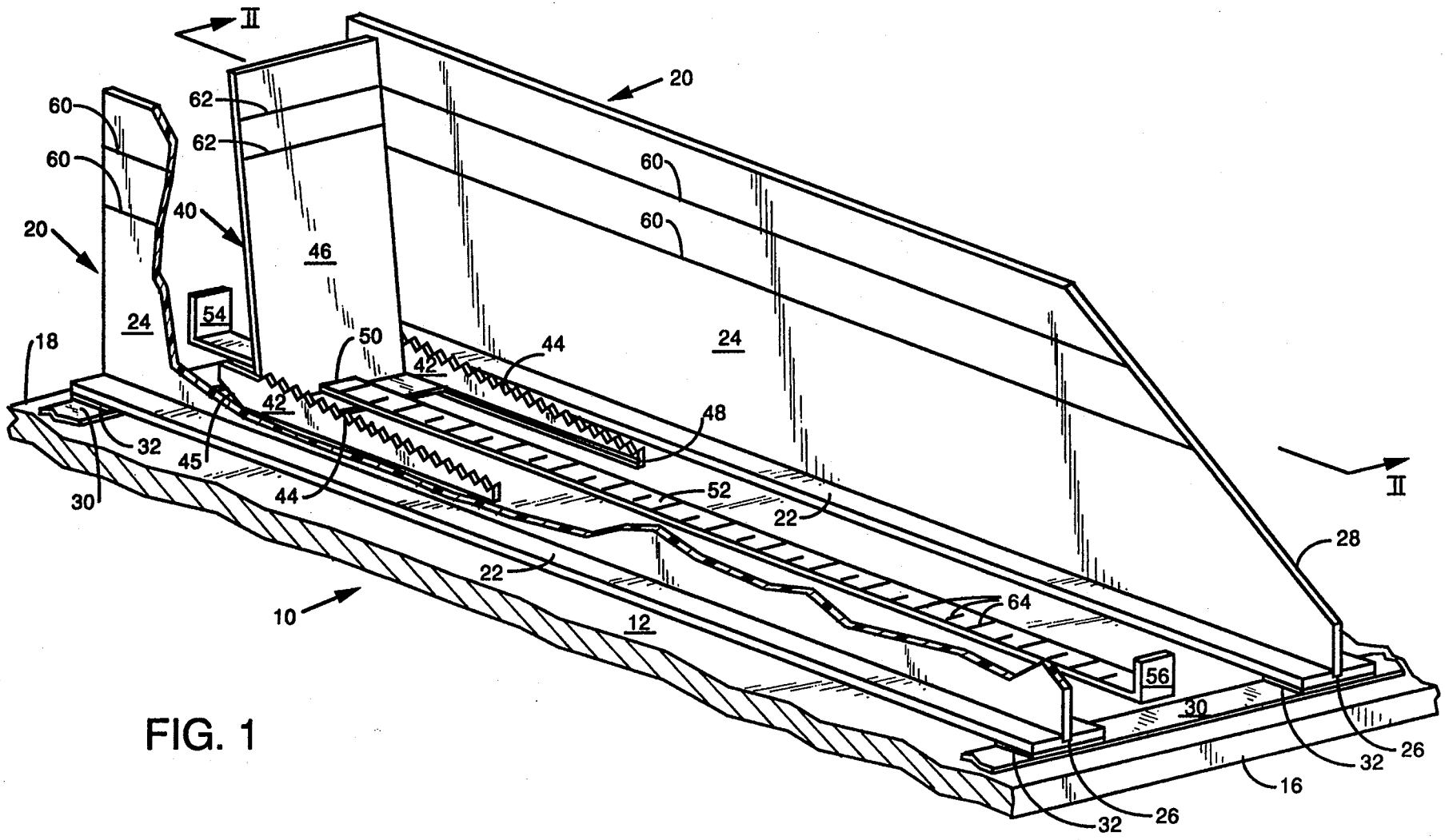
FIG. 1 is a perspective view, partially broken away, of a first embodiment of a shelf allocation and management system in accordance with the present invention.

A shelf allocation and management system 10, according to a first embodiment of the present invention, is illustrated in FIGS. 1–4. The shelf allocation and management system 10 allocates space along a shelf 12 among rows of products 14. The shelf allocation and management system 10 also provides for the movement of the rows of products 14 toward the front 16 of the shelf 12.

A plurality of side rails 20 is positioned on the shelf 12 with each side rail 20 extending from the front 16 of the shelf 12 to the back 18 of the shelf 12. Each side rail 20 includes a generally flat rail base 22 which is positioned substantially parallel to the shelf 12. A rigid, thin divider 24 is attached to the rail base 22 and extends upwardly away from the rail base 22. The divider 24 forms a minimum-thickness divider between product rows. This minimum-thickness divider between rows allows any individual row of products 14 to be advanced on the shelf 12 independent of an adjacent row while maximizing the utilization of shelf width. The divider 24 additionally minimizes product damage from adjacent products.

A groove 26 extends across the top surface of the rail base 22 and is adapted to receive the divider 24 for attachment to the rail base 22. This configuration allows the side rails 20 to be of built-up/welded construction from flat stock, thereby minimizing construction cost. However, the side rails 20 may be extruded if desired. The front edge 28 of the divider 24 is tapered toward the front 16 of the shelf 12. This construction permits easier viewing of the product 14 in that row and decreases the obstruction when viewing an entire product row.

The side rails 20 may be removably attached into appropriate positions on the shelf 12. Various mechanisms may be utilized for non-permanently adhering the side rails 20 to the shelf 12 such as, for example, double face adhesive tape or hook and loop type fasteners such as Velcro ®. FIG. 1 illustrates two strips of connecting material 30 which extend longitudinally along the length of the shelf 12 at the front 16 and the back 18 thereof. Shorter sections of corresponding connecting material 32 are attached to the bottom surface of the rail base 22. The two strips of connecting material 30 may be reinforced with a plastic support strip (not shown) for bridging wire shelving. Adhesive may be provided on the bottom of the support strip to adhere the support strip to the shelf 12. The connecting material 30 and the corresponding connecting material 32 may be formed of a loop material of hook and loop type fasteners such as Velcro ®. With this arrangement, when the products 14 are resting on the rail bases 22 (as will be discussed hereinafter), the loop-to-loop connection of the connecting material. 30 and the corresponding connecting material 32 prevents any lateral displacement of the side rails 20. The loop-to-loop connection provides the advantage of easy removal and repositioning of the side rails 20 when the products 14 have been removed.

Figure 4:
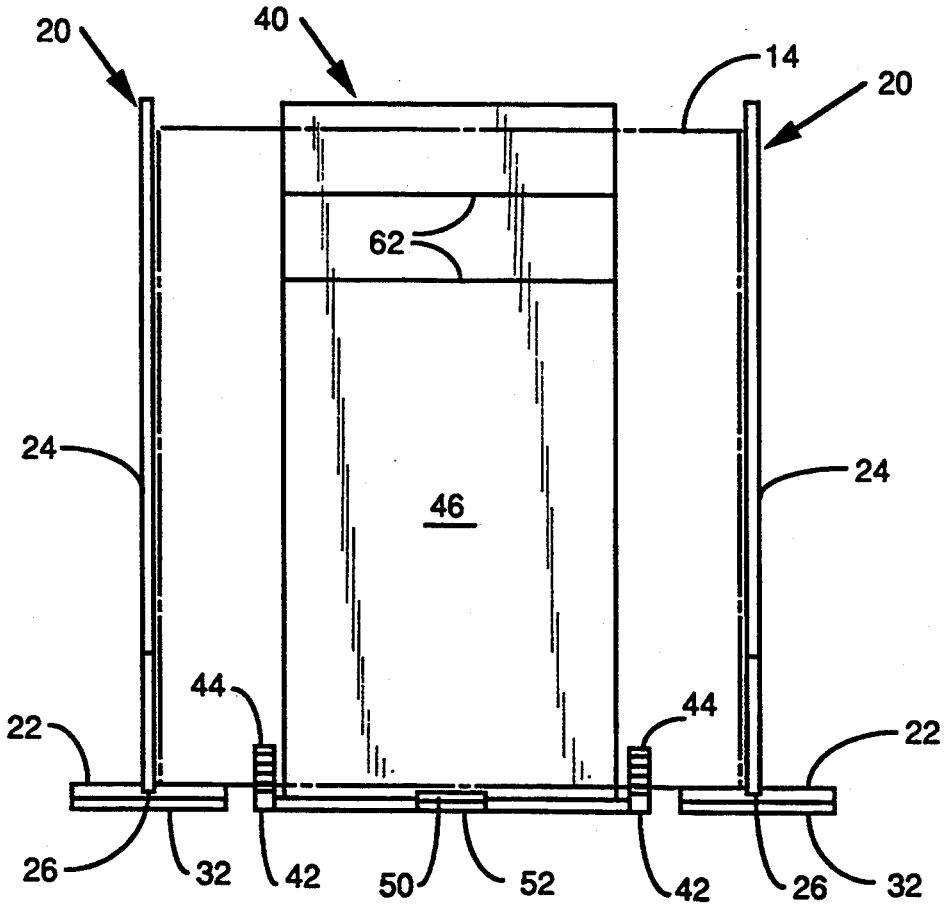
FIG. 4 is a front elevational view of the shelf allocation and management system of FIG. 1 with a package shown in phantom.

As illustrated in FIG. 4, the products 14 are positioned between dividers 24 of adjacent side rails 20 and may be supported on the rail bases 22 of the adjacent side rails 20. Supporting the products 14 on the rail bases 22 will lift the products 14 off the shelf 12. This provides a greater degree of airflow underneath the products 14 and provides a significant advantage for products stored in a freezer. In a freezer environment, the increased airflow around the product 14 will maintain a more uniform temperature within the product 14.

A backstop 40 is positioned between the dividers 24 of adjacent side rails 20. The backstop 40 is movable between the front 16 and the back 18 of the shelf 12 and is adapted to engage and advance a row of products 14 positioned between adjacent side rails 20 toward the front 16 of the shelf 12.

The backstop 40 includes a backstop base formed of a pair of base legs 42. Each base leg 42 is tapered toward the front 16 of the shelf 12 such that the general height of the base leg 42 decreases toward the front 16 of the shelf 12. In the embodiment shown in FIG. 1, a top surface of the base legs 42 includes a plurality of engaging teeth 44 which is adapted to engage with and position products 14. The base legs 42 include a beveled edge 45 on the bottom surface facing the rear of the shelf 12. The beveled edge 45 minimizes interference between the strip of connecting material 30 and the backstop 40.

The base legs 42 are attached to opposed sides of a back plate 46 such that the back plate 46 extends generally upwardly from the base legs 42. The base legs 42 extend behind the back plate 46 to prevent the backstop 40 from tipping. The back plate 46 may be attached to the base legs 42 by being received in a groove 48 which extends across one face of each base leg 42 such that the opposed sides of the base plate 46 are received in the respective groove 48 of the base legs 42. The groove 48 provides for easier manufacture of the base legs 42. Alternatively, a slot of a specific length to receive the opposed sides of the back plate 46 may be molded or machined into the base legs 42. The back plate 46 is positioned at an angle greater than 90°, preferably approximately 100°, with respect to the base legs 42. Consequently, the back plate 46 will be leaning toward the back 18 of the shelf 12.

Figure 2:
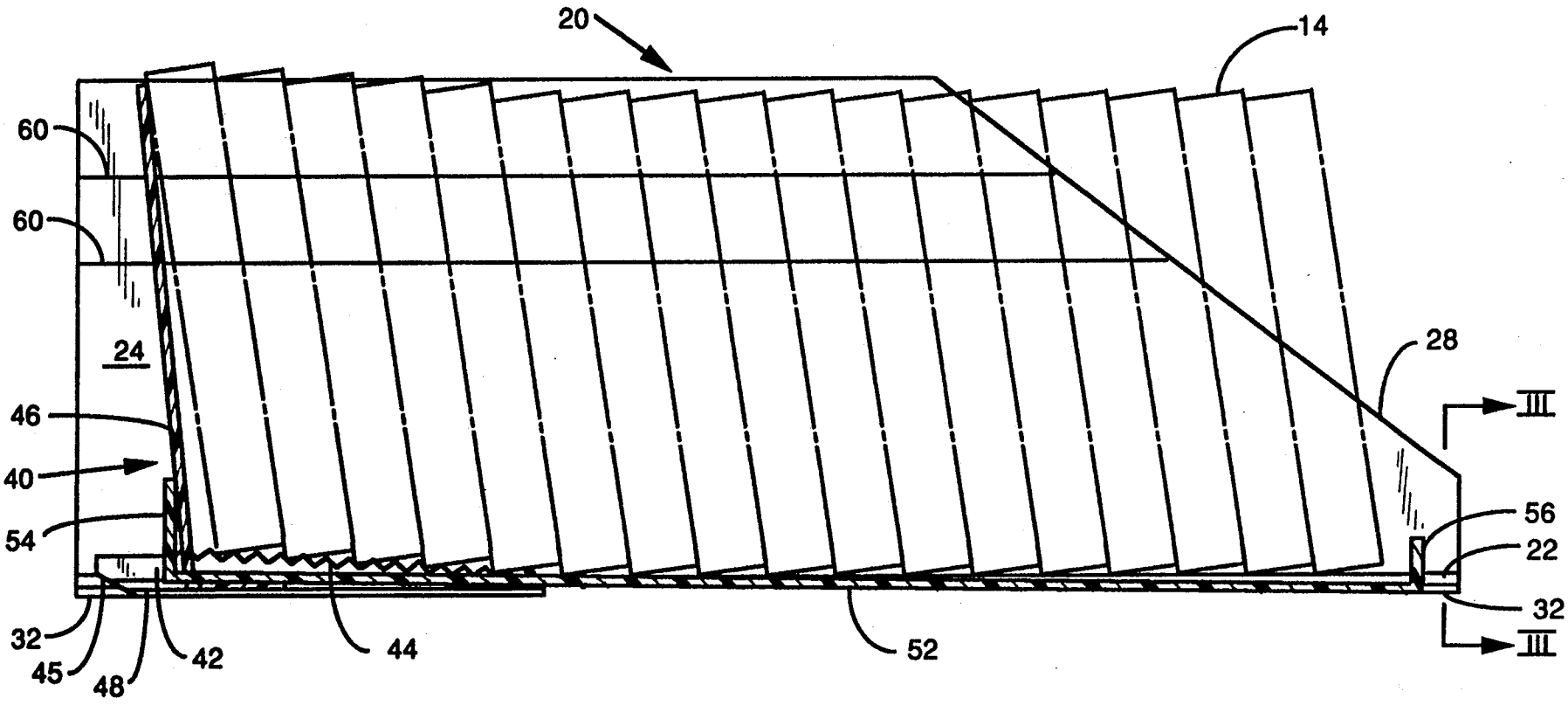
FIG. 2 is a section taken along line II—II in FIG. 1, with a row of packages shown in phantom.
Figure 3:
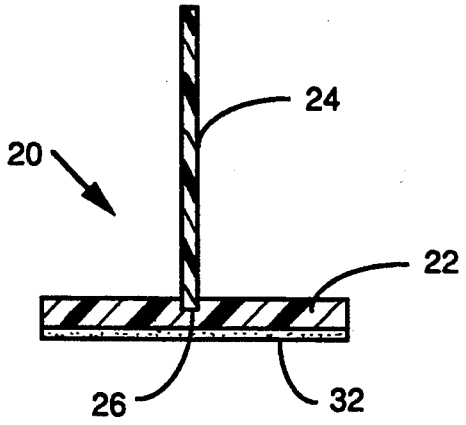
FIG. 3 is a section taken along line III—III of FIG. 2.

The angle of the back plate 46 and the provision of engaging teeth 44 on the base legs 42 combine to form an effective mechanism for positioning the row of products 14 in the desired orientation. As seen in FIG. 2, the last product 14 in the row can be leaned against the back plate 46 at a desired pitch with the edge of the product 14 contacting the engaging teeth 44. The engaging teeth 44 will also contact the next few products 14 in the row, thereby establishing and maintaining the pitch for the products 14 in the row. The entire row of products 14 will thereby maintain the appropriate orientation.

A slot 50 is provided in the back plate 46 and is substantially parallel to the rail base 22 and the shelf 12. The slot 50 is positioned below the top surface of the base legs 42 adjacent the back plate 46. The slot 50 is adapted to slideably receive a puller member 52. The puller member 52 includes a backstop engaging portion 54 at one end and a gripping element in the form of an upturned finger tab 56 positioned near an end of the puller member 52 adjacent the front 16 of the shelf 12.

The shelf allocation and management system 10 operates as follows. The products 14 are positioned in a row between the dividers 24 of adjacent side rails 20 with the backstop 40 designating the appropriate pitch for the row of products 14, although multiple rows of products either side-by-side, on top of each other or combinations thereof, may also be utilized. In the back of the row, the products 14 will be supported on the base legs 42. Due to the taper of the base legs 42, the height of the row of products 14 will gradually decrease until the products 14 are supported on the rail bases 22, as shown in FIG. 2. Due to the combination of the base legs 42 and the rail bases 22, the products will be positioned above the puller member 52 so that there is always a clearance between the products 14 and the puller member 52, as shown in FIG. 4. As the products 14 are removed from the row, it will become important to advance the row of products 14 toward the front 16 of the shelf 12. The puller member 52 is manually pulled toward the front 16 of the shelf 12 so that the backstop engaging portion 54 engages with the back of the backstop 40, as shown in FIG. 2. Further advancing the puller member 52 toward the front 16 of the shelf 12 will also move the backstop 40 toward the front 16 of the shelf 12. The movement of the backstop 40 will advance the row of products 14 toward the front 16 of the shelf 12 as needed. After advancing the products 14 as desired, the puller member 52 may be slid back into a substantially out-of-sight position onto shelf 12, except for finger tab 56, underneath the row of products 14. The process can be repeated as often as needed. When the row of products 14 has been exhausted or when restocking is necessary, the backstop 40 can be manually pushed back toward the back 18 of the shelf and the row of products 14 appropriately restocked, preferably placing the new products in the back of the row.

Additionally, as shown in FIG. 1, score marks 60 and 62 may be provided in the side rails 20 and the back plate 46 of the backstop 40, respectively. These score marks 60 and 62 allow for a portion of the divider 24 or back plate 46 to be broken off so that the height of the divider 24 and the back plate 46 can be adjusted appropriately. This configuration allows one mold or manufacturing technique to produce a variety of heights of side rails 20 and back plate 46. Furthermore, markings 64 may be provided on the puller member 52 to indicate the amount of space remaining on the shelf 12 when the products 14 are advanced to the front 16 as an aid for restocking purposes.

Figure 5:
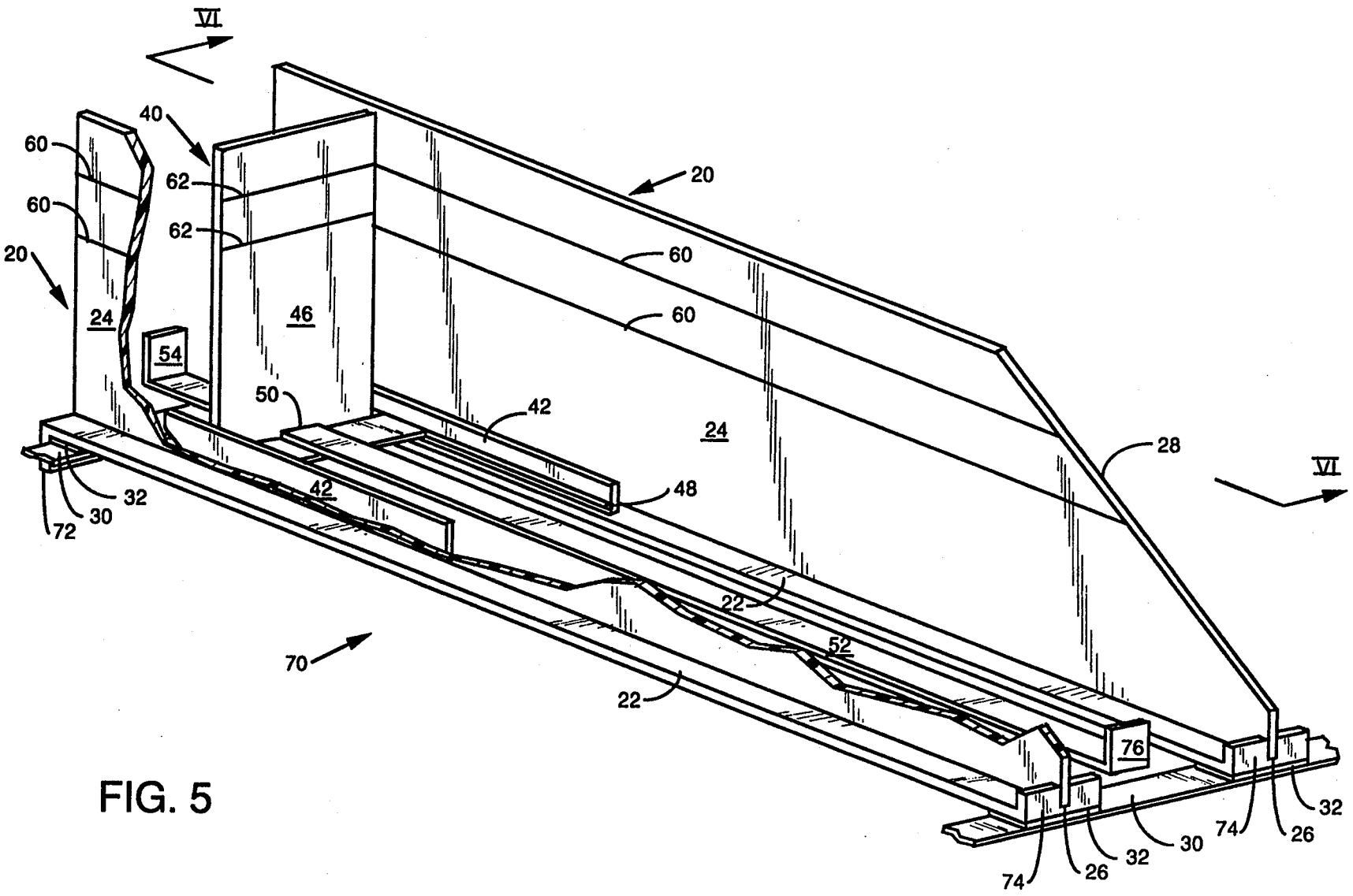
FIG. 5 is a perspective view, partially broken away, of a second embodiment of a shelf allocation and management system in accordance with the present invention.
Figure 6:
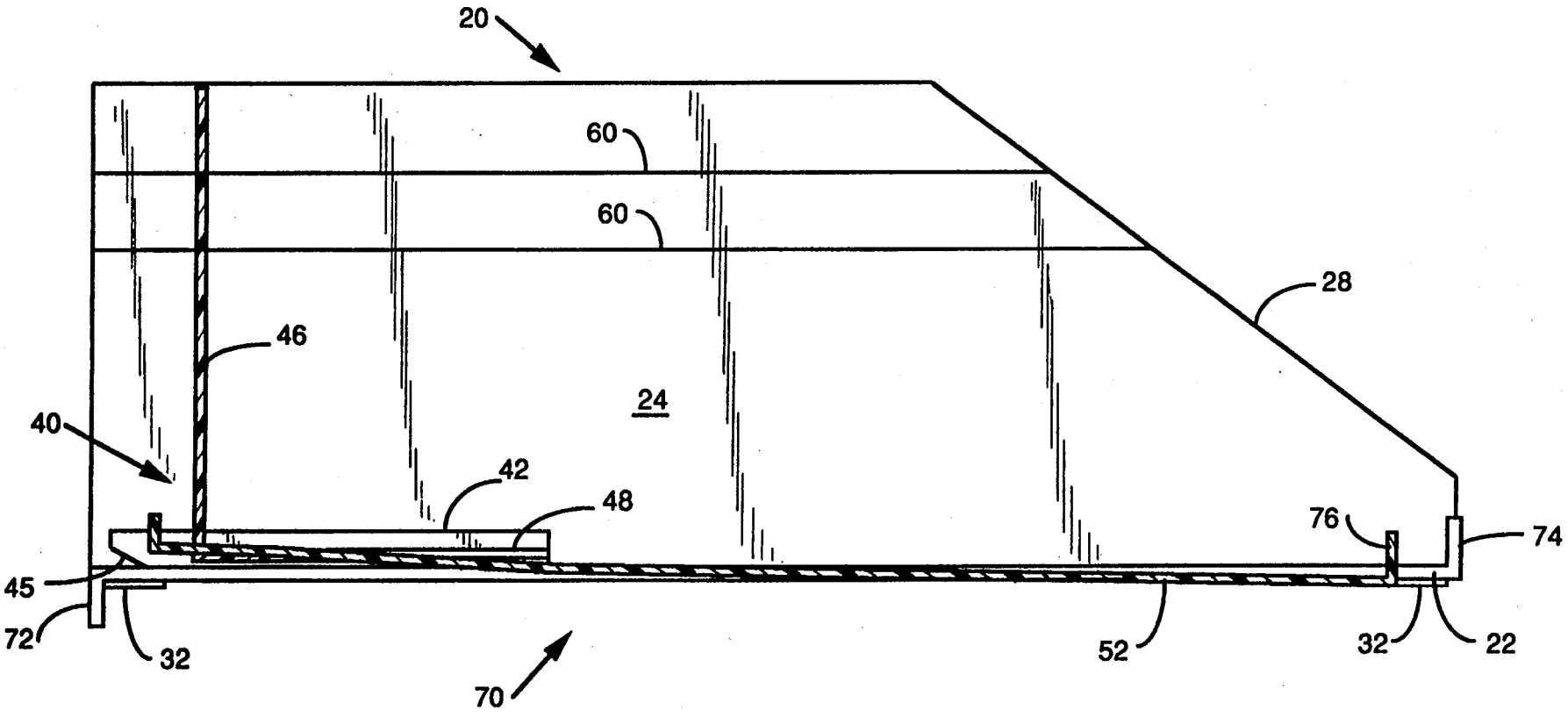
FIG. 6 is a section taken along line VI—VI of FIG. 5.

FIGS. 5–6 illustrate a shelf allocation and management system 70 according to a second embodiment of the present invention. The shelf allocation and management system 70 includes a plurality of side rails 20; a backstop 40 positioned between the dividers 24 of adjacent side rails 20; a puller member 52 receivable in the slot 50 of the back plate 46 of the backstop 40; and other associated elements similar to the shelf allocation and management system 10 discussed above.

The shelf allocation and management system 70 differs from the shelf allocation and management system 10 of FIGS. 1–5 by additionally providing a hook 72 attached to each rail base 22 at an end of the side rail 20 which is adjacent the back 18 of the shelf 12. The hook 72 will engage an edge of the back 18 and prevent forward movement of the side rails 20. This arrangement will be particularly well-adapted for sloped shelves 12. A stop member 74 is attached to the rail base 22 and the divider 24 at an end of the side rail 20 which is adjacent the front 16 of the shelf 12. The stop member 74 is adapted to engage with the products 14 to prevent the products 14 from being advanced past the front 16 of the shelf 12. This provides an additional safety feature for the shelf allocation and management system 70.

The base legs 42 of the shelf allocation and management system 70 have not been provided with a tapered portion or engaging teeth 44 which provide for a more easily manufactured base leg 42. The base plate 46 is substantially perpendicular to the base legs 42 in the shelf allocation and management system 70. The puller member 52 of the shelf allocation and management system 70 does include a finger tab 76 adjacent the front 16 of the shelf 12. The upturned finger tab 76 is particularly useful in a shelf 12 which has an upturned front edge or ledge. The upturned finger tab 76, like finger tab 56, will extend a sufficient height such that the user can easily grab the finger tab 76 even if the shelf 12 includes an upturned ledge.

The shelf allocation and management system 70 is shown in an alternative configuration wherein the base legs 42 are riding on the rail bases 22 of the side rails 20. This configuration accommodates narrow products 14 and operates substantially the same as the shelf allocation and management system 10 described above. The products 14 will be supported in a row with the back of the products 14 supported on the base legs 42 while the products 14 near the front of the row which are beyond the base legs 42 will be supported on the rail bases 22 of the side rails 20. The base legs 42 and the rail bases 22 combine to maintain a clearance between the products and the puller member 52 such that the puller member 52 can be utilized to advance the backstop 40 and the associated row of products 14, as described above.

Figure 7:
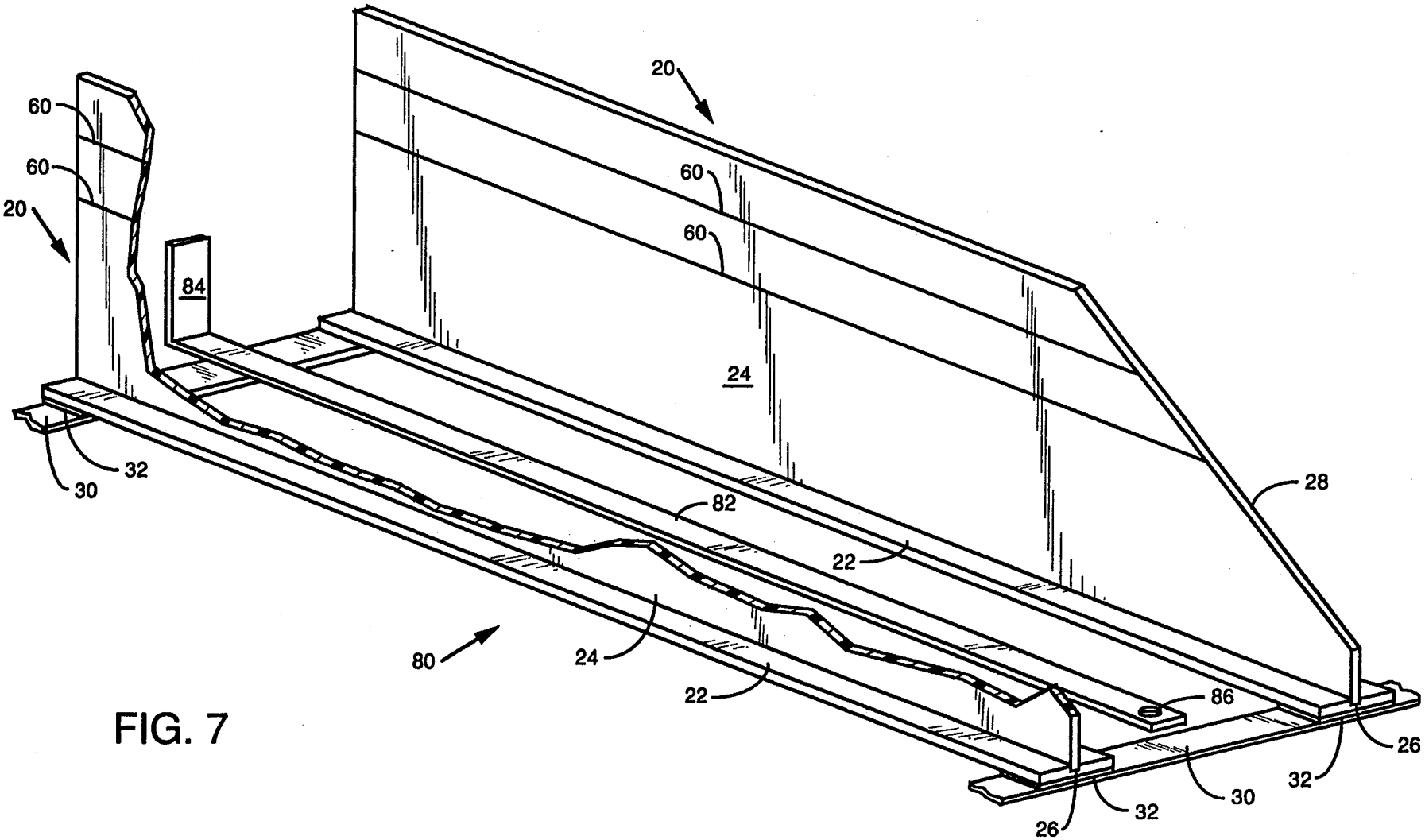
FIG. 7 is a perspective view, partially broken away, of a third embodiment of a shelf allocation and management system in accordance with the present invention.

A shelf allocation and management system 80 according to a third embodiment of the present invention is shown in FIG. 7. The shelf allocation and management system 80 is similar to the shelf allocation and management systems 10 and 70 described above. The shelf allocation and management system 80 differs in that a puller member 82 includes a backstop 84 integrally attached to an end of the puller member 82 which is adjacent the back 18 of the shelf 12. The puller member 82 includes a finger hole 86 analogous to finger tab 56; however, finger hole 86 allows for the entire puller member 82 to be slid into an out-of-sight position under the row of products 14.

In operation, the shelf allocation and management system 80 operates similarly to the shelf allocation and management systems 10 and 70 described above except that the backstop 84 does not remain in contact with the row of products 14. The backstop 84 will only contact the products 14 when the puller member 82 has been manually advanced toward the front 16 of the shelf so that the backstop 84 engages the row of products 14 to advance the products 14 toward the front 16 of the shelf 12. In this embodiment as in the previous embodiments, the products 14 will ride on the rail bases 22 so as to maintain a clearance between the products 14 and the puller member 82. This clearance allows for the puller member 82 to be easily advanced and retracted as needed.

Figure 8:
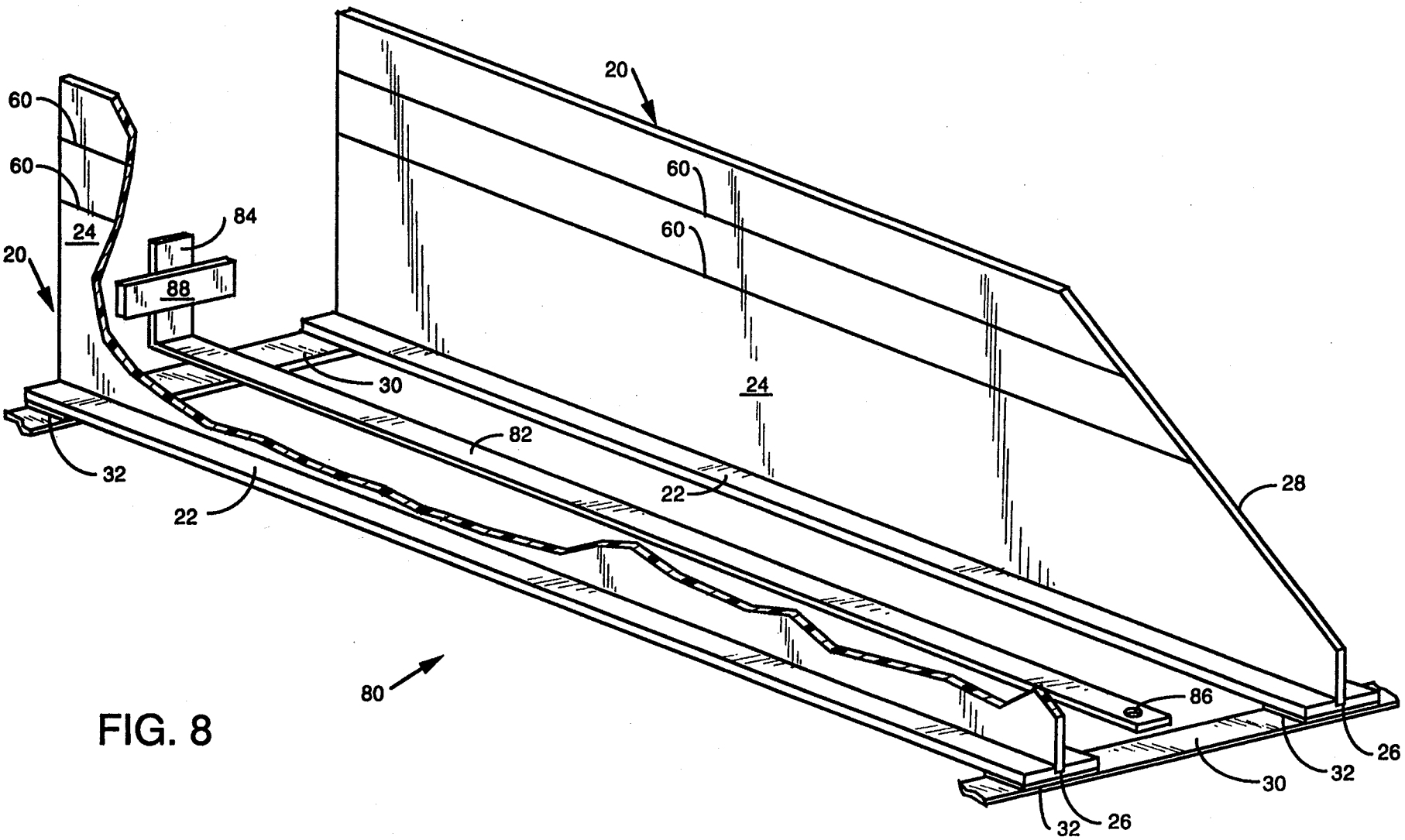
FIG. 8 is a perspective view, partially broken away, of a fourth embodiment of a shelf allocation and management system in accordance with the present invention.

FIG. 8 illustrates a fourth embodiment of the present invention. This embodiment is identical to the shelf allocation and management system 80 described in connection with FIG. 7 above except that the backstop 84 further includes a cross bar 88 extending transversely thereto. The cross bar 88 can provide a more efficient backstop for certain types of products or for multiple rows of products than merely using backstop 84 alone.

Figure 9:
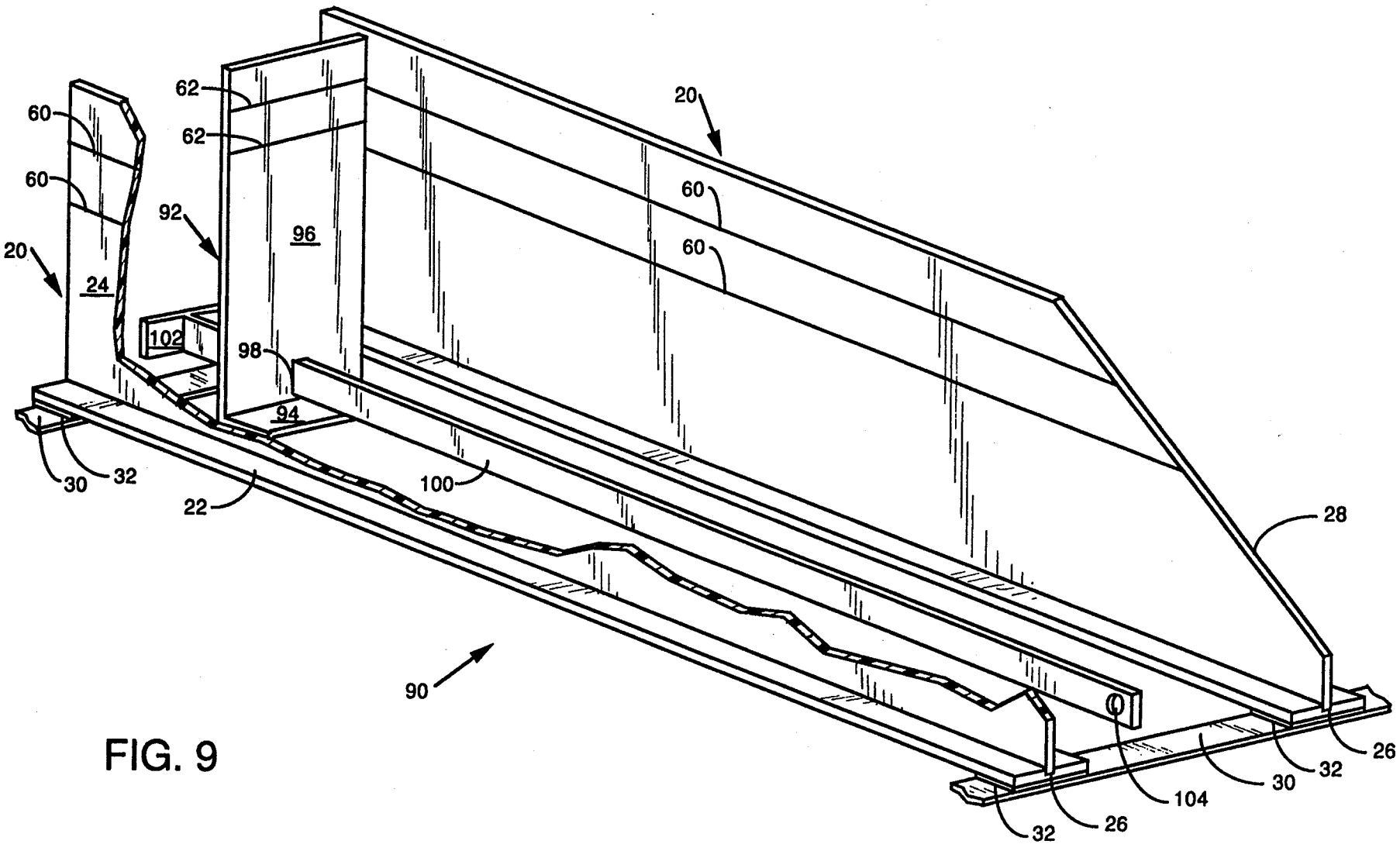
FIG. 9 is a perspective view, partially broken away, of a fifth embodiment of a shelf allocation and management system in accordance with the present invention.

FIG. 9 illustrates a shelf allocation and management system 90 according to a fifth embodiment of the present invention. The shelf allocation and management system 90 includes side rails 20 and associated elements as described above. Furthermore, the shelf allocation and management system 90 includes a backstop 92 having an integral base member 94 and back plate 96. A vertical slot 98 is provided substantially in the center of the back plate 96. The slot 98 is substantially parallel to the divider 24 of adjacent side rails 20. The slot 98 is adapted to slideably receive a puller member 100. The puller member 100 includes a backstop engaging portion 102 adjacent the back 18 of the shelf 12. Puller member 100 includes a finger hole 104 for gripping the puller member 100 that is positioned near the end of the puller member 100 which is adjacent the front 16 of the shelf 12.

The shelf allocation and management system 90 is adapted to be used with two rows of products 14 positioned between adjacent side rails 20, with the puller member 100 extending between the two rows of products 14. Each product row may be supported on an individual rail base 22. The puller member 100 may also engage the products to maintain them positioned and supported on the rail base 22. In operation, the shelf allocation and management system 90 is analogous to the shelf allocation systems 10, 70 and 80 discussed above. As needed, the puller member 100 is manually advanced toward the front 16 of the shelf so that the back plate 96 and the associated rows of products are correspondingly advanced to the front 16 of the shelf as needed. The puller member 100 is then returned to a position out of the way on the shelf 12.

Figure 10:
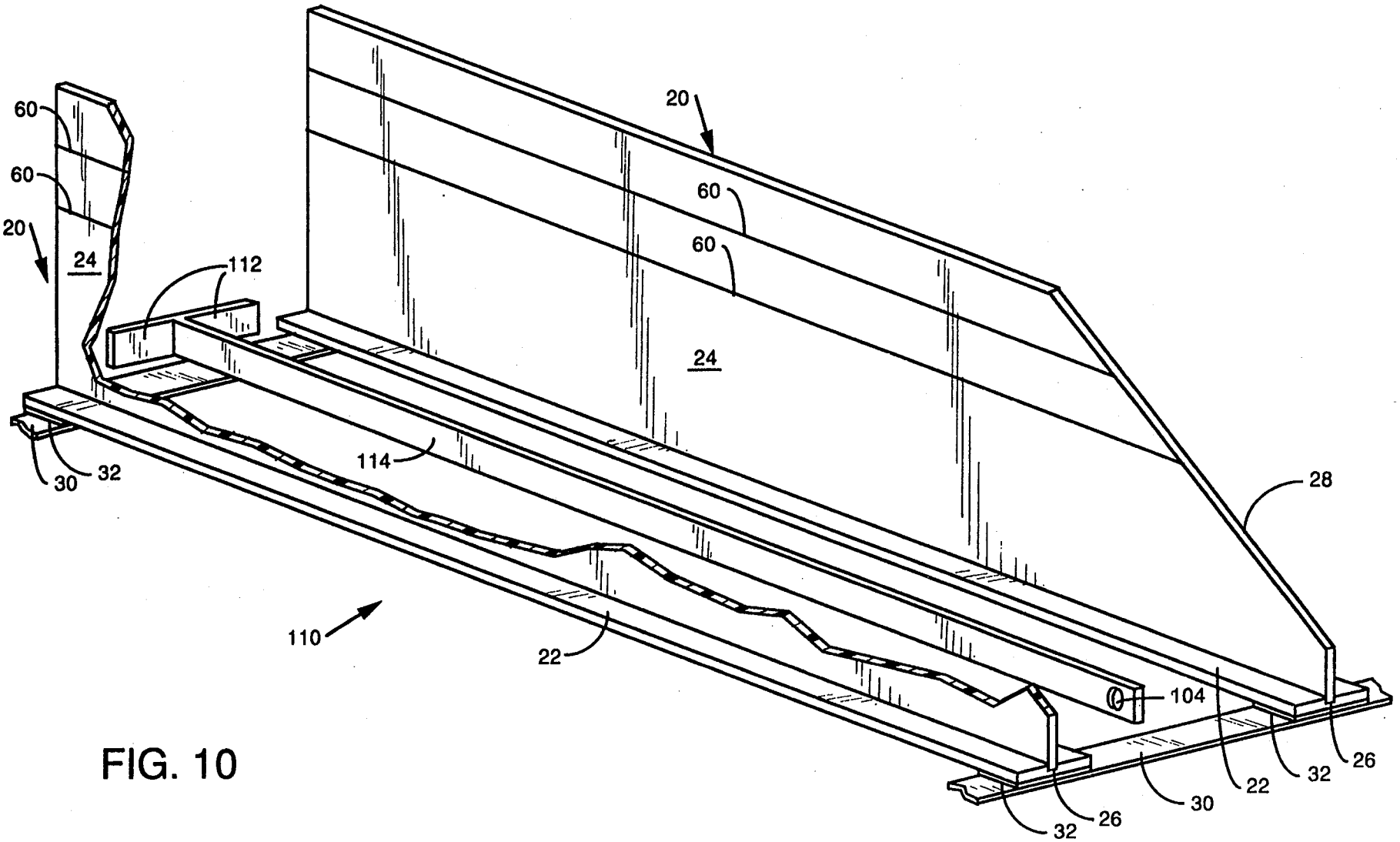
FIG. 10 is a perspective view, partially broken away, of a sixth embodiment of a shelf allocation and management system in accordance with the present invention.

A shelf allocation and management system 110 according to a sixth embodiment of the present invention is illustrated in FIG. 10. The shelf allocation and management system 110 is similar in design to the shelf allocation and management system 90 described above. The shelf allocation and management system 110 includes a backstop 112 integral with the puller member 114. The shelf allocation and management system 110 operates analogously to the shelf allocation and management system 90 described above except that the backstop 112 does not maintain a constant contact with the row of products 14 since the backstop 112 is formed integral with the puller member 114.

Specific embodiments of the present invention have been described in detail herein, and it will appreciated by those skilled in the art that various modifications and alternatives to the embodiments could be developed in light of the overall teachings of the disclosure. For example, many features of specific detailed embodiments described above could be incorporated into the other disclosed embodiments such as, for example, the finger tab 56, the hook 72 and the stop member 74. Accordingly, the particular arrangements are illustrative only and are not limiting as to the scope of the present invention which is to be given the full breadth of the appended claims and any and all equivalents thereof.

What is claimed is:

1. A shelf allocation and management system for allocating shelf space among rows of products and for moving the rows of products toward the front of the shelf, said shelf allocation and management system comprising:

at least two adjacent side rails positioned on the shelf extending from the front of the shelf to the back of the shelf, each said side rail including a generally flat rail base and a rigid divider attached to and extending upwardly from said rail base, wherein each said rail base includes a groove extending across a top surface thereof in which said divider is received and wherein at least one row of products may be positioned between said dividers of said adjacent side rails;

an unbiased backstop positioned between said dividers of said adjacent side rails, said backstop movable between the front and the back of the shelf and adapted to engage and advance at least one row of products which may be positioned between said dividers of said adjacent side rails toward the front of the shelf; and a rigid puller member positioned between said dividers of said adjacent side rails and associated with said backstop, said puller member adapted to be manually moved toward the front and the back of the shelf to move said backstop at least toward the front of the shelf.

2. The shelf allocation and management system of claim 1 wherein said backstop is integral with said puller member.

3. The shelf allocation and management system of claim 1 wherein at least some of the at least one row of products which may be positioned between said dividers of said adjacent side rails are adapted to be supported on said rail bases of said adjacent side rails.

4. The shelf allocation and management system of claim 3 wherein said puller member is spaced from the at least one row of products which may be positioned between said dividers of said adjacent side rails.

5. A shelf allocation and management system for allocating shelf space among rows of products and for moving the rows of products toward the front of the shelf, said shelf allocation and management system comprising:

at least two adjacent side rails positioned on the shelf extending from the front of the shelf to the back of the shelf, each said side rail including a generally flat rail base and a rigid divider attached to and extending upwardly from said rail base, wherein at least one row of products may be positioned between said dividers of said adjacent side rails;

an unbiased backstop positioned between said dividers of said adjacent side rails, said backstop movable between the front and the back of the shelf and adapted to engage and advance at least one row of products which may be positioned between said dividers of said adjacent side rails toward the front of the shelf, wherein said backstop includes a backstop base, a back plate attached to said backstop base which extends generally upwardly therefrom, and a slot in said back plate adapted to slideably receive said puller member: and a rigid puller member positioned between said dividers of said adjacent side rails and associated with said backstop, said puller member adapted to be manually moved toward the front and the back of the shelf to move said backstop at least toward the front of the shelf.

6. The shelf allocation and management system of claim 5 wherein said puller member extends through said slot and includes a backstop engaging portion which is adapted to be abutted against said back plate to move said backstop by said manual movement of said puller member.

7. The shelf allocation and management system of claim 6 wherein said slot is substantially parallel to said dividers.

8. The shelf allocation and management system of claim 6 wherein said slot is substantially parallel to said rail bases.

9. The shelf allocation and management system of claim 6 wherein said backstop base includes a pair of base legs attached to opposed sides of said back plate.

10. The shelf allocation and management system of claim 9 wherein said back plate is positioned at an angle greater than 90° with respect to said base legs and a top surface of each said base leg includes a plurality of engaging teeth and each of said base legs having a tapered portion such that the general height of said base leg decreases toward the front of the shelf.

11. The shelf allocation and management system of claim 9 wherein each said base leg includes a groove extending across one side of said base leg, wherein said opposed sides of said base plate are received in said groove.

12. The shelf allocation and management system of claim 9 wherein each said base leg includes a beveled bottom surface toward the back of the shelf.

13. The shelf allocation and management system of claim 1 wherein said puller member includes a grip means positioned near an end of said puller member which is adjacent the front of the shelf.

14. The shelf allocation and management system of claim 13 wherein said grip means includes an upwardly extending portion attached to an end of said puller member which is adjacent the front of the shelf.

15. The shelf allocation and management system of claim 1 wherein each of said side rails is removably attached to the shelf.

16. A shelf allocation and management system for allocating shelf space among rows of products and for moving the rows of products toward the front of the shelf, said shelf allocation and management system comprising:

at least two adjacent side rails positioned on the shelf extending from the front of the shelf to the back of the shelf, each said side rail including a generally flat rail base and a rigid divider attached to and extending upwardly from said rail base, wherein at least one row of products may be positioned between said dividers of said adjacent side rails, wherein each of said side rails is removable attached to the shelf, and wherein at least one strip of connecting material extends longitudinally along the length of the shelf, and a corresponding connecting material is attached to a bottom surface of said rail bases;

an unbiased backstop positioned between said dividers of said adjacent side rails, said backstop movable between the front and the back of the shelf and adapted to engage and advance at least one row of products which may be positioned between said dividers of said adjacent side rails toward the front of the shelf; and a rigid puller member positioned between said dividers of said adjacent side rails and associated with said backstop, said puller member adapted to be manually moved toward the front and the back of the shelf to move said backstop at least toward the front of the shelf.

17. The shelf allocation and management system of claim 16 wherein said strip of connecting material is formed of a loop material of a hook and loop type fastener, and said corresponding connecting material which is attached to a bottom surface of said rail bases is formed of a loop material of a hook and loop type fastener.

18. The shelf allocation and management system of claim 1 wherein at least a portion of each said divider is tapered toward the front of the shelf.

19. A shelf allocation and management system for allocating shelf space among rows of products and for moving the rows of products toward the front of the shelf, said shelf allocation and management system comprising:

at least two adjacent side rails positioned on the shelf extending from the front of the shelf to the back of the shelf, each said side rail including a generally flat rail base and a rigid divider attached to and extending upwardly from said rail base, wherein each said divider includes score marks extending along the sides thereof which allow for decreasing the height of said divider, and wherein at least one row of products may be positioned between said dividers of said adjacent side rails;

an unbiased backstop positioned between said dividers of said adjacent side rails, said backstop movable between the front and the back of the shelf and adapted to engage and advance at least one row of products which may be positioned between said dividers of said adjacent side rails toward the front of the shelf; and a rigid puller member positioned between said dividers of said adjacent side rails and associated with said backstop, said puller member adapted to be manually moved toward the front and the back of the shelf to move said backstop at least toward the front of the shelf.

20. The shelf allocation and management system of claim 1 wherein each said side rail includes a hook attached to said rail base at an end of said side rail which is adjacent the back of the shelf.

21. The shelf allocation and management system of claim 1 wherein each said side rail includes a stop member attached to said rail base and said divider at an end of said side rail which is adjacent the front of the shelf.

* * * * *

UNITED STATES PATENT AND TRADEMARK OFFICE

CERTIFICATE OF CORRECTION

PATENT NO. : 5,413,229

DATED : May 9, 1995

INVENTOR(S) : H. Richard Zuberbuhler, James R. Burchell and David F. Sorosky

It is certified that error appears in the above-indentified patent and that said Letters Patent is hereby corrected as shown below:

Title page, under section [56] References Cited, U.S. PATENT DOCUMENTS, "2,980,259 4/1961 Foulds ... 211/59.3" should read --2,980,259 4/1961 Fowlds ... 211/59.3--.

Claim 16 Line 50 Column 9 "removable" should read --removably--.

Signed and Sealed this

Third Day of October, 1995

*Attest:*

*Attesting Officer*

BRUCE LEHMAN

*Commissioner of Patents and Trademarks*